United States Patent [19]

Roper, Jr. et al.

[11] 4,373,967

[45] Feb. 15, 1983

[54] PROCESS FOR MAKING RESULFURIZED MACHINABLE STEEL

[75] Inventors: Charles R. Roper, Jr., Coatesville; John K. Strattan, Dowingtown; Roy Hetherington, Jr., West Chester; Austin J. Hiller, Coatesville, all of Pa.

[73] Assignee: Lukens, Inc., Coatesville, Pa.

[21] Appl. No.: 174,760

[22] Filed: Aug. 5, 1980

Related U.S. Application Data

[62] Division of Ser. No. 28,435, Apr. 9, 1979, abandoned.

[51] Int. Cl.[3] ..... C21D 7/00

[52] U.S. Cl. ..... 148/2; 75/55; 75/58; 75/123 G; 75/129; 148/36

[58] Field of Search ..... 75/123 G, 58, 55, 129; 148/2, 36

[56] References Cited

U.S. PATENT DOCUMENTS 2,272,277 2/1942 Ramsey et al. ..... 75/123 G

*Primary Examiner*—R. Dean

*Attorney, Agent, or Firm*—Penrose Lucas Albright

[57] ABSTRACT

A melt is produced composed of iron, manganese and carbon in known ratios for free-cutting carbon steel with sulfur being included at roughly 0.15%. Aluminum and silicon are added to kill the steel fully and silica and alumina are added to the slag as conditioners in the ladle in sufficient amounts to provide a low ladle slag V-ratio (ratio of weight percent CaO to weight percent $SiO_2$) of approximately two to one to retard desulfurization during a subsequent ladle treatment process wherein sulfur modifying powders such as calcium carbide, calcium silicon or, alternatively, magnesium-bearing materials are injected into the meld in an argon stream at a rate of about two pounds of contained calcium (or one pound of contained magnesium) per ton of liquid steel over a period of six to seven minutes. The low V-ratio slag holds desulfurization to about 30% while permitting effective calcium treatment of the molten steel. The resultant inclusions in the plate product are favorable to machinability and consist of a fine, nearly uniform distribution of sulfide inclusions throughout the plate thickness with a minimum of oxide inclusions such as silicates and alumina. An example of a steel chemistry according to the invention is carbon 0.16 to 0.23 weight percent, manganese 1.0 to 1.4 weight percent, sulfur 0.07 to 0.15 weight percent, silicon 0.35 weight percent maximum, aluminum 0.030 weight percent maximum and iron for the balance.

3 Claims, No Drawings

PROCESS FOR MAKING RESULFURIZED MACHINABLE STEEL

RELATED APPLICATIONS

This a division of application Ser. No. 28,435, filed Apr. 9, 1979, abandoned.

BACKGROUND OF THE INVENTION

Certain steels characterized as free-cutting steels or machinable steels are advantageous for machining purposes. A number of such steels are known and have different advantages relating to the particular machining process to be used, the size, the shape, and surface finish required commercially, the economy of operations, and the like. Such machinable steels include certain carbon steels, resulfurized carbon steels, rephosphorized carbon steels, leaded carbon steel, carburizing steels, alloy carburizing steels, and certain hardenable alloy steels.

During the early 1960's, free machining steels which exhibited superior internal quality in thicknesses up to twelve inches, in comparison with plain resulfurized free-machining steels, were developed by using special lead addition equipment, by controlling sulfur levels and, in some cases, by vacuum degassing the molten steel. However, in the early 1970's, environmental requirements which govern the production of leaded steels became highly restrictive and, as a result, the production of leaded steels became more difficult and considerably more expensive. A need thus arose for a substitute steel which could be produced without lead while maintaining the desired machinability and internal quality of the steel.

It is well-known that resulfurized steels have better machinability than steels of the same composition without the sulfur added to the steel. Table I shows twenty-two steels in the SAE 1100 series of free-cutting steels. Sulfur is added to such steels for the sole purpose of decreasing the machinability cost by increasing productivity through greater machining speeds and improved tool life.

TABLE I

FREE-CUTTING CARBON STEEL COMPOSITIONS

| SAE NO. | C | Mn | P (range or max) | S | Si | Pb |
|---|---|---|---|---|---|---|
| 1111 | 0.13 max. | 0.60–0.90 | 0.07–0.12 | 0.08–0.15 | | |
| 1112 | 0.13 max. | 0.70–1.00 | 0.07–0.12 | 0.16–0.23 | | |
| 1113 | 0.13 max. | 0.70–1.00 | 0.07–0.12 | 0.24–0.33 | | |
| 12L14 | 0.15 max. | 0.80–1.20 | 0.04–0.09 | 0.25–0.35 | | 0.15–0.35 |
| 1108 | 0.80–0.13 | 0.50–0.80 | 0.040 | 0.08–0.13 | 0.10 max. | |
| 1109 | 0.08–0.13 | 0.60–0.90 | 0.040 | 0.08–0.13 | 0.10 max. | |
| 1115 | 0.13–0.18 | 0.60–0.90 | 0.040 | 0.80–0.13 | as specified up to 0.30 | |
| 1117 | 0.14–0.20 | 1.00–1.30 | 0.040 | 0.08–0.13 | as specified up to 0.30 | |
| 1118 | 0.14–0.20 | 1.30–1.60 | 0.040 | 0.08–0.13 | as specified up to 0.30 | |
| 1119 | 0.14–0.20 | 1.00–1.30 | 0.040 | 0.24–0.33 | as specified up to 0.30 | |
| SAE NO. | C | Mn | P max. | S | Si | |
| 1120 | 0.18–0.23 | 0.70–1.00 | 0.040 | 0.80–0.13 | as specified up to 0.30 | |
| 1126 | 0.23–0.29 | 0.70–1.00 | 0.040 | 0.80–0.13 | as specified up to 0.30 | |
| 1132 | 0.27–0.34 | 1.35–1.65 | 0.040 | 0.08–0.13 | as specified up to 0.30 | |
| 1137 | 0.32–0.39 | 1.35–1.65 | 0.040 | 0.08—0.13 | as specified up to 0.30 | |
| 1138 | 0.34–0.40 | 0.70–1.00 | 0.040 | 0.08–0.13 | as specified up to 0.30 | |
| 1139 | 0.35–0.43 | 1.35–1.65 | 0.040 | 0.12–0.20 | as specified up to 0.30 | |
| 1140 | 0.37–0.44 | 0.70–1.00 | 0.040 | 0.08–0.13 | as specified up to 0.30 | |
| 1141 | 0.37–0.45 | 1.35–1.65 | 0.040 | 0.08–0.13 | as specified up to 0.30 | |
| 1144 | 0.40–0.48 | 1.35–1.65 | 0.040 | 0.24–0.33 | as specified up to 0.30 | |
| 1145 | 0.42–0.49 | 0.70–1.00 | 0.040 | 0.04–0.07 | as specified up to 0.30 | |
| 1146 | 0.42–0.49 | 0.70–1.00 | 0.040 | 0.08–0.13 | as specified up to 0.30 | |
| 1151 | 0.48–0.55 | 0.70–1.00 | 0.040 | 0.08–0.13 | as specified up to 0.30 | |

Table II discloses two alloy carburizing steels, SAE 4024 and 4028. It is known that better machining alloys can be obtained by the addition of sulfur. Two widely used alloy steels, SAE 4340 and 8640, may have their machinability improved, without comprising dimensional accuracy, through the addition of sulfur.

TABLE II

ALLOY CARBURIZING STEELS

| SAE NO. | C | Mn | P | S | Si | Mo |
|---|---|---|---|---|---|---|
| 4024 | 0.20–0.25 | 0.70–0.90 | 0.040 max. | 0.035–0.050 | 0.20–0.35 | 0.20–0.30 |
| 4028 | 0.25–0.30 | 0.70–0.90 | 0.040 max. | 0.035–0.050 | 0.20–0.35 | 0.20–0.30 |

The larger sulfide inclusions in resulfurized steels tend to cause pitting and cracking on the machined surface, thus limiting their use. This is in contrast to leaded grades of steel wherein there is no significant or discernible difference in static strength, ductility or notch sensitivity between fine-grain leaded carbon steels and their non-leaded counterparts. Accordingly, if the starch for a substitute for leaded steels was to be found in resulfurized steels, then it was necessary to eliminate or minimize large sulfide inclusions in such resulfurized steels as may cause pitting and cracking.

SUMMARY OF THE INVENTION

The instant invention relates to resulfurized carbon steels which do not have lead or other toxic elements and which have a lower relative sulfur level whereby machinability and internal quality are maintained, such steels being different from other free machining steels not only because of the significantly lower sulfur levels, usually about 0.10 weight percent as compared to 0.25 weight percent for most competitive grades, but also because of the reduced size of sulfide inclusions in comparison with known resulfurized carbon steels, and further, because of the minimization of alumina and silicate inclusions which are detrimental to tool wear. In addition, a more uniform dispersion of sulfide inclusions is provided throughout the thickness of the steel plate which assists in proper chip formation and a good machined-surface finish.

Resulfurized steel, in accordance with the invention, in its initial form is normally produced in electric furnaces. After tapping, chemical compounds containing calcium or magnesium or both are injected into a ladle containing the molten metal by a ladle refining process known as the Calcium Argon Blowing or "CAB" process wherein the reactive metal vaporizes, deoxidizes the steel and combines with non-metallic oxide inclusions existing in the molten steel. The resulting inclusions are largely absorbed by the slag which has a low V-ratio of approximately two to one. The calcium or magnesium or both remaining in the molten steel is available to combine with other inclusions as they form during solidification. This provides a measure of inclusion control by greatly reducing silicate and alumina inclusions and modifying a portion of the sulfide inclusions. The resulting steel plates, up to twelve inches in thickness, have an internal soundness equivalent to an aluminum or silicon killed steel but without the disadvantages of abrasive silicate and alumina inclusions.

When compared to competitive resulfurized or leaded steel plates, steel plates produced in accordance with the instant invention are advantageous in the free-cutting carbon steel art because of their improved subsurface quality and internal soundness, their improved cleanliness, the excellent machined surface finish which is obtained, superior machining characteristics imparted to the steel such as provide longer tool life, and the capacity to be cut by a gas torch without the need for a special exhaust system inasmuch as lead additions or other toxic elements such as selenium or tellurium are not present. Further the steel can be chromium plated. Notch toughness and transverse ductility remain at satisfactory levels in the resulting steel plate.

The objects of the inventive concepts disclosed herein are directed to the process for producing steel plates in accordance with the invention and the resulting steel plates so produced. However, other objects, adaptabilities and capabilities of the invention will be appreciated by those skilled in the art.

DESCRIPTION OF THE PREFERRED EMBODIMENTS

The instant invention involves a unique process for the manufacture of a variety of resulfurized free-machining steel plate compositions which are also unique. These steels are advantageous in that they do not contain lead or other toxic element additions and can be produced over a wide range of gages up to twelve inches. The process utilizes a calcium-argon-blowing (CAB) treatment of the molten metal in the ladle. Heretofore, the primary purpose of the CAB process has been to remove sulfur from steel for the purpose of producing low sulfur steels. However, to produce a resulfurized steel, the process has been modified whereby sulfur removal is minimized while, at the same time, the benefits of inclusion control have been obtained. The result is a steel plate having a fine, nearly uniform distribution of sulfide inclusions throughout its gage and a minimum of oxide inclusions. Both of these factors contribute significantly to the improved machinability and surface finish of the steel.

Steels produced in accordance with the invention are remarkably free of detrimental oxide inclusions such as alumina and silicates while the beneficial sulfide inclusions are distributed uniformly throughout the steel, the number of the sulfide inclusions being dependent on the sulfur content. These various characteristics of the steel, particularly the uniform distribution of fine sulfide inclusions, provide machinability levels equivalent to or better than those achieved in much higher sulfur free-machining steels. It is considered that the optimum sulfur range for steels in accordance with the invention is 0.07 to 0.15%. The reduction in quantity of oxide inclusions coupled with such a relatively low sulfur level for a free-machining steel results in an unusually clean steel in comparison with other resulfurized steels.

It is considered that the process wherein the calcium-argon-blowing technique is utilized is independent of the steel chemistry to the extent that all grades of carbon and alloy free-machining steels can be produced by the process.

The process of the invention is directed first to the production of a melt which is free of lead and other toxic elements and is composed of iron, manganese and carbon in ratios known for free-cutting carbon steels and with sulfur in the melt being provided at about 0.15%, or in any event, in a range of about 0.14 to 0.16%.

Silicon and aluminum (which are used for deoxidation for fully killing the steel) and the sulfur which is required for the resulfurization of the steel are added to the molten metal either in the steelmaking electric furnace or in the ladle. Also, as previously mentioned, special slag conditioners, silica and alumina, are added to the ladle prior to tap. The addition results in a low ladle-slag V-ratio, the ratio of weight percent CaO to weight percent $SiO_2$, which is approximately two to one and which retards the desulfurization during the subsequent CAB processing. No further additions are made during tap. However, in the CAB unit, sulfur modifying powders such as calcium carbide, calcium-silicon, or functionally equivalent magnesium-bearing materials are injected into the metal in an argon stream. About two pounds of contained calcium per ton of liquid steel (or one pound per ton of contained magnesium) are injected into the metal over a period of about five to ten minutes and preferably about six to seven minutes. The low V-ratio slag restrains desulfurization to about 30% and permits, at the same time, effective calcium treatment of the molten steel which results in calcium modified inclusions in the steel-plate produced or, where magnesium-bearing materials are utilized, in magnesium-modified inclusions in such product.

After CAB treatment, the molten steel is either cast in ingot molds by bottom pouring or is solidified into a continuous slab by passage through a continuous casting machine. The resultant ingots or slabs are subsequently heated in a soaking pit and rolled into plate.

In theory, the best inclusions for the purpose of the instant invention would be globular. However, it has been found in practice that the inclusions of this invention are much smaller and therefore do not elongate as much as would otherwise be the case. The result is an improved machined-surface finish and a reduced cracking tendency. Examples of steel chemistries which have been satisfactorily produced according to the invention are as follows:

TABLE III

| Element | Percentage |
|---|---|
| Carbon | 0.17% to 0.23% |
| Manganese | 1.0% to 1.4% |
| Sulfur | 0.07% to 0.15% |
| Silicon | 0.35% maximum |
| Phosphorus | 0.04% maximum |
| Aluminum | 0.03% maximum |
| Iron | Balance |

TABLE IV

| Element | Percentage |
|---|---|
| Carbon | 0.14% to 0.22% |
| Manganese | 0.90% to 1.50% |
| Sulfur | 0.07% to 0.15% |
| Phosphorus | 0.040% maximum |
| Silicon | 0.10% to 0.40% |
| Aluminum | 0.03% maximum |
| Iron | Balance |

TABLE V

| Element | Percentage |
|---|---|
| Carbon | 0.37% to 0.44% |
| Manganese | 0.70% to 1.20% |
| Sulfur | 0.07% to 0.15% |
| Phosphorus | 0.040% maximum |
| Silicon | 0.10% to 0.40% |
| Aluminum | 0.030% maximum |
| Iron | Balance |

The steel plate of Table IV above was rolled to a five inch gauge. It displayed a yield strength of 45,600 psi and a tensile strength of 76,300 psi with an elongation of 24% and a reduction in area of 45.5%. The Table V steel was rolled to a gauge of 6½ inches and exhibited a yield strength of 44,000 psi, a tensile strength of 85,500 psi with an elongation of 17% and a reduction in area up to 28%.

In each of the above steels, which were fully killed, there was a nearly uniform distribution of fine sulfide inclusions throughout the gauge. The steels were substantially free of detrimental oxide inclusions such as alumina and silica and silicates.

Such steels constitute premium quality free-machining steels which have application in particular for the production of high quality molds, hydraulic manifolds, gears and sprockets, jigs and fixtures and mounting plates.

Unless otherwise indicated, all percentages are by weight.

Although the preferred embodiments of the invention are described, it is to be understood that the inventive concepts are susceptible to other adaptations and modifications within the scope of the appended claims.

Having thus described our invention, what we claim as new and desire to secure by Letters Patent of the United States is:

1. In a process for making a resulfurized free-cutting carbon steel plate which is free of lead and other toxic elements such as selenium and tellurium and is substantially free of oxide inclusions of alumina and silicates, the process including the steps of producing a melt which is free of lead and other toxic elements and is composed of iron, manganese and carbon in ratios for free-cutting carbon steel, with sulfur being included at about 0.15 percent, adding silicon and aluminum as necessary to fully deoxidize the molten metal, adding silica and alumina as slag conditioners in the ladle as sufficient to produce a low ladle slag V-ratio (CaO to $SiO_2$) of approximately two to one, tapping the molten metal into the ladle, treating the molten metal in the ladle by a calcium-argon-blowing process wherein calcium carbide and calcium-silicon are injected into the molten metal in an argon stream at a rate of about two pounds of contained calcium per ton of molten metal over a period of five to ten minutes as sufficient to reduce the sulfur content to 0.07 to 0.15%, substantially removing silicate and alumina inclusions, thereafter casting said molten metal into an ingot or continuous cast slab.

2. A method in accordance with claim 1 wherein said ingot or slab is reduced by rolling to a plate which has a thickness not greater than twelve inches.

3. A method in accordance with claim 1 wherein magnesium-bearing materials are injected into the molten metal during the calcium-argon-blowing process.

* * * * *